US006172025B1

(12) United States Patent
Johnson et al.

(10) Patent No.: US 6,172,025 B1
(45) Date of Patent: Jan. 9, 2001

(54) VEHICULAR CLEANING SOLUTION COMPRISING MINERAL SPIRITS AND JEWELER'S ROUGE

(76) Inventors: Bobby C. Johnson; Henry D. Shook, both of 925 Della La., Newton, NC (US) 28658

( * ) Notice: Under 35 U.S.C. 154(b), the term of this patent shall be extended for 0 days.

(21) Appl. No.: 09/065,197

(22) Filed: Apr. 23, 1998

(51) Int. Cl.[7] ..... B24B 3/02

(52) U.S. Cl. ..... 510/241; 510/245; 510/254; 510/268; 510/407; 510/208; 510/209; 51/309; 106/10; 106/3; 106/11

(58) Field of Search ..... 510/245, 254, 510/268, 407, 208, 209, 241; 51/309; 106/10, 3, 11

(56) References Cited

U.S. PATENT DOCUMENTS 4,308,060 * 12/1981 Talbot ..... 106/9
4,853,000 * 8/1989 Potter ..... 51/309
4,938,945 * 7/1990 Mahmood et al. ..... 423/489

* cited by examiner

*Primary Examiner*—Yogendra Gupta
*Assistant Examiner*—Charles Boyer

(57) ABSTRACT

A vehicle cleaning solution is provided including a predetermined amount of mineral spirits and a predetermined amount of jeweler's rouge mixed with the mineral spirits for cleaning various vehicular components.

6 Claims, 1 Drawing Sheet

VEHICULAR CLEANING SOLUTION COMPRISING MINERAL SPIRITS AND JEWELER'S ROUGE

BACKGROUND OF THE INVENTION

1. Field of the Invention

The present invention relates to cleaning solutions and more particularly pertains to a new vehicular cleaning solution for cleaning various surfaces on a vehicle.

2. Description of the Prior Art

The use of cleaning solutions is known in the prior art. More specifically, cleaning solutions heretofore devised and utilized are known to consist basically of familiar, expected and obvious structural configurations, notwithstanding the myriad of designs encompassed by the crowded prior art which have been developed for the fulfillment of countless objectives and requirements.

Known prior art cleaning solutions include U.S. Pat. No. 4,308,060; U.S. Pat. No. 4,064,061; U.S. Pat. No. 4,116,699; U.S. Pat. No. 5,575,837; U.S. Pat. No. 3,410,703; and U.S. Pat. No. 1,382,026.

In these respects, the vehicular cleaning solution according to the present invention substantially departs from the conventional concepts and designs of the prior art, and in so doing provides an apparatus primarily developed for the purpose of cleaning various surfaces on a vehicle.

SUMMARY OF THE INVENTION

In view of the foregoing disadvantages inherent in the known types of cleaning solutions now present in the prior art, the present invention provides a new vehicular cleaning solution construction wherein the same can be utilized for cleaning various surfaces on a vehicle.

The general purpose of the present invention, which will be described subsequently in greater detail, is to provide a new vehicular cleaning solution apparatus and method which has many of the advantages of the cleaning solutions mentioned heretofore and many novel features that result in a new vehicular cleaning solution which is not anticipated, rendered obvious, suggested, or even implied by any of the prior art cleaning solutions, either alone or in any combination thereof.

To attain this, the present invention generally comprises a new cleaning solution afforded by the mixture of a plurality various liquids under certain conditions. As shown in FIG. 1, the mixture includes a predetermined amount of mineral spirits and a predetermined amount of jeweler's rouge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vehicular cleaning solution apparatus and method which has many of the advantages of the cleaning solutions mentioned heretofore and many novel features that result in a new vehicular cleaning solution which is not anticipated, rendered obvious, suggested, or even implied by any of the prior art cleaning solutions, either alone or in any combination thereof.

It is another object of the present invention to provide a new vehicular cleaning solution which may be easily and efficiently manufactured and marketed.

It is a further object of the present invention to provide a new vehicular cleaning solution which is of a durable and reliable construction.

An even further object of the present invention is to provide a new vehicular cleaning solution which is susceptible of a low cost of manufacture with regard to both materials and labor, and which accordingly is then susceptible of low prices of sale to the consuming public, thereby making such vehicular cleaning solution economically available to the buying public.

Still yet another object of the present invention is to provide a new vehicular cleaning solution which provides in the apparatuses and methods of the prior art some of the advantages thereof, while simultaneously overcoming some of the disadvantages normally associated therewith.

Still another object of the present invention is to provide a new vehicular cleaning solution for cleaning various surfaces on a vehicle.

Even still another object of the present invention is to provide a new vehicular cleaning solution that include a predetermined amount of mineral spirits and a predetermined amount of jeweler's rouge mixed with the mineral spirits for cleaning various vehicular components.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
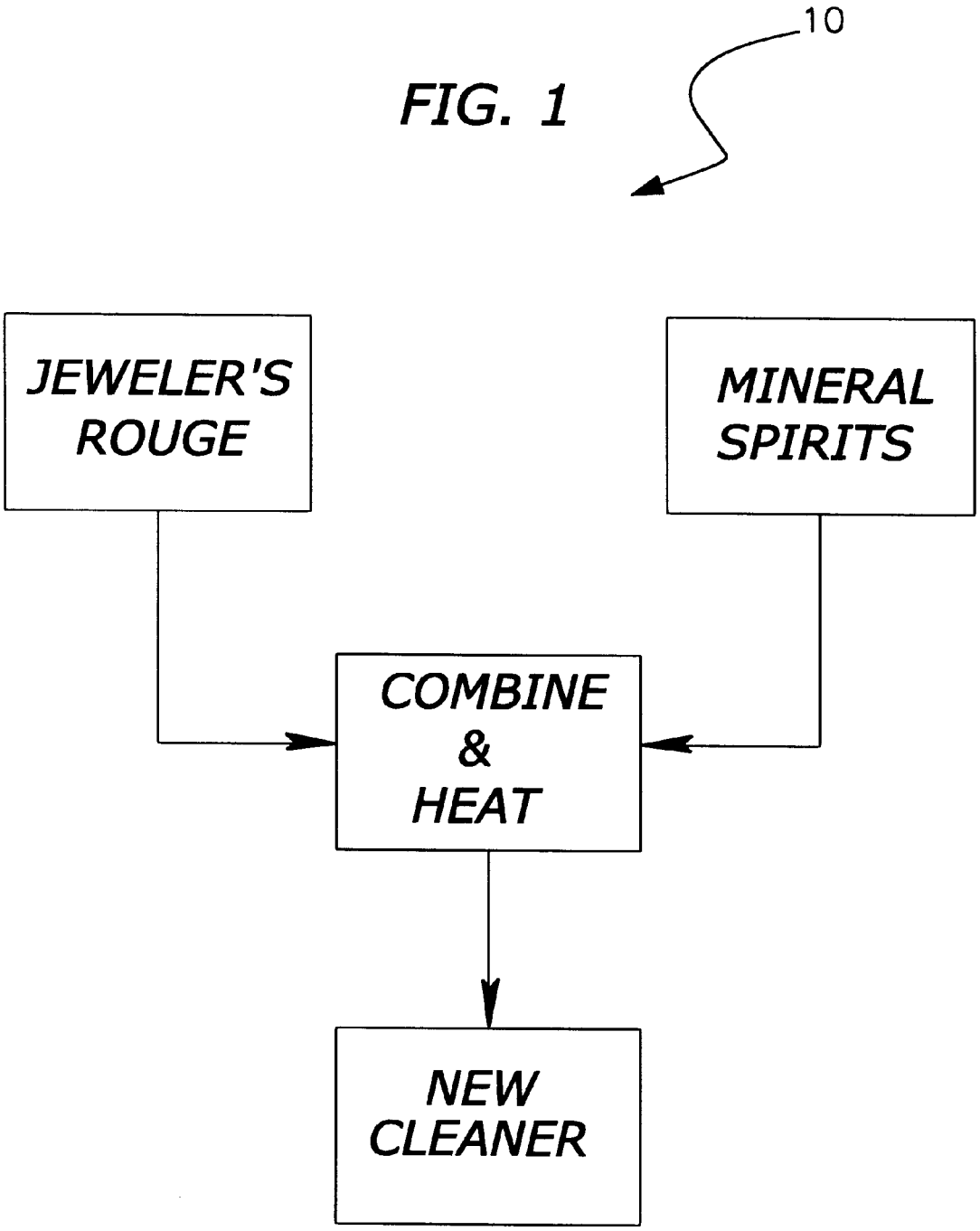
FIG. 1 is a flowchart view for making a new vehicular cleaning solution according to the present invention.

With reference now to the drawings, and in particular to FIG. 1 thereof, a new vehicular cleaning solution embodying the principles and concepts of the present invention and generally designated by the reference numeral 10 will be described.

The present invention, designated as numeral 10, includes a new cleaning solution afforded by the mixture of a plurality various liquids under certain conditions. As shown in FIG. 1, the mixture includes a predetermined amount of mineral spirits and a predetermined amount of jeweler's rouge. The mineral spirits and jeweler's rouge are mixed in a manner which will soon be set forth for cleaning various vehicular components. In the preferred embodiment, the mineral spirits constitute approximately 11/13 of a total amount of the cleaning solution. Further, the amount of jeweler's rouge constitutes approximately 2/13 of a total amount of the cleaning solution. Ideally, 22 ounces of mineral spirits and 4 ounces of jewelry rouge are used.

The method associated with the present invention will now be set forth. After the mineral spirits and jewelry rouge are provided in the amounts set forth hereinabove, the same are mixed to afford a mixture. Such mixture is then placed in a 36 ounce heat conductive container and heat is applied. Ideally, such heat is applied for a sufficient duration and magnitude such that the same surpasses a temperature of 200 degrees. Ideally, a duration of approximately 15 minutes is employed. Thereafter, the mixture is stirred at the desired temperature until a desired viscosity is obtained, or the mixture appears to be "milky" in texture. Finally, the heat is removed until the mixture reaches room temperature.

In use, the mixture is applied to various vehicle components for cleaning the same. It is important that approximately 1 drop of the new cleaning solution is applied to every 10 square inches of the vehicle. The present invention is preferably used to remove tar, insects, and dirt from metal surfaces, and could be used in below freezing temperatures. Furthermore, the present invention affords a shielding affect that causes water to bead and is effective at temperatures below 32 degrees.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A vehicle cleaning solution comprising, in combination:

an amount of mineral spirits; and an amount of jeweler's rouge mixed with the mineral spirits for cleaning various vehicular components;

wherein the amount of mineral spirits constitutes 11/13 of the total amount of the cleaning solution.

2. A vehicle cleaning solution as set forth in claim 1 wherein the amount of mineral spirits is 22 ounces.

3. A vehicle cleaning solution as set forth in claim 1 wherein the amount of jeweler's rouge constitutes 2/13 of the total amount of the cleaning solution.

4. A method of cleaning a vehicle comprising the steps of:

providing an amount of mineral spirits constituting 11/13 of the total amount of the cleaning solution;

providing an amount of jeweler's rouge constituting 2/13 of the total amount of the cleaning solution;

mixing the mineral spirits and jeweler's rouge thereby affording a mixture;

applying heat to the mixture such that the same surpasses a temperature of 200 degrees Fahrenheit;

stirring the mixture until a desired viscosity is obtained;

cooling the mixture until the same reaches room temperature; and applying one drop of the mixture to an approximate 10 square inch area of any one of various vehicle components for cleaning the same.

5. A vehicle cleaning solution as set forth in claim 2 wherein the amount of jeweler's rouge is 4 ounces.

6. A method of cleaning a vehicle as set forth in claim 4 wherein the mixture is heated for about 15 minutes.

* * * * *